US005863280A

United States Patent [19]

Wang

[11] Patent Number: 5,863,280

[45] Date of Patent: Jan. 26, 1999

[54] MULTI-PURPOSE EXERCISER

[76] Inventor: Wei-Chen Wang, 3 Fl., No. 30, Lane. 151, Jen Ai Rd., Sec. 4, Taipei, Taiwan

[21] Appl. No.: 985,966

[22] Filed: Dec. 5, 1997

[51] Int. Cl.[6] ..... A63B 23/02

[52] U.S. Cl. ..... 482/140; 482/142; 482/907

[58] Field of Search ..... 482/140, 142, 482/907, 132; D21/191, 196, 193

[56] References Cited

U.S. PATENT DOCUMENTS

| | | | |
|---|---|---|---|
| 4,706,953 | 11/1987 | Graham | 482/132 |
| 5,267,926 | 12/1993 | Schaefer | 482/142 |
| 5,492,520 | 2/1996 | Brown | 482/142 |
| 5,591,111 | 1/1997 | Wang et al. | 482/142 |
| 5,632,710 | 5/1997 | England | 482/140 |
| 5,702,334 | 12/1997 | Lee | 482/140 |
| 5,711,749 | 1/1998 | Millers | 482/142 |
| 5,728,035 | 3/1998 | Sands | 482/142 |

*Primary Examiner*—Jerome Donnelly

*Attorney, Agent, or Firm*—Pro-Techtor International Services

[57] ABSTRACT

A multi-purpose exerciser which includes a U-shaped base frame having two smoothly arched parallel ends and a back pad on the middle, an axle transversely mounted in the U-shaped base frame to hold a pair of pulleys outside the base frame and an elongated polyurethane rollers within the base frame for supporting the user's hips, a T-bar pivoted to the back pad and holding a pair of pulleys, a support frame bar adapted to support the back pad on the floor, the support frame bar having a bottom end holding a supporting wheel for supporting on the floor, a guide pulley mounted on the support frame bar, a handlebar having two locating members near two opposite ends thereof, a pull rope inserted through the guide pulley with its two opposite ends respectively passed through the pulleys on the axle then the pulleys on the T-bar and then coupled to the two locating members on the handlebar by a respective adjusting clamp, and two stop members bilaterally fastened to the pull rope and spaced between the pulleys on the T-bar and the locating members on the handlebar.

3 Claims, 5 Drawing Sheets

MULTI-PURPOSE EXERCISER

BACKGROUND OF THE INVENTION

The present invention relates to exercising machines, and more particularly to a multi-purpose exerciser which is portable and, which massages the hips and the thighs when operated to exercise the muscles of the trunk and the hands.

A variety of exercising machines have been developed for exercising different parts of the body, and have appeared on the market. When operating conventional exercising machines to exercise the muscles of the chest and abdomen, the user shall have to lie on a flat board, and then to pull a chest weight, or to bend the body. Operating these exercising machines is monotonous, and the user tends to get tired of exercising the body. Before operating the chest weight, the user must adjust the weight of the chest weight subject to one's physical condition. Furthermore, these conventional exercising apparatus cannot massage the muscles of the hips and the thighs when operated.

SUMMARY OF THE INVENTION

It is one object of the present invention to provide a multi-purpose exerciser which enables the user to keep the body in a sitting position during exercising. It is another object of the present invention to provide a multi-purpose exerciser which massages the muscles of the hips and the thigh when it is operated. It is still another object of the present invention to provide a multi-purpose exerciser which is suitable for men as well as women of different ages. To achieve these and other objects of the present invention there is provided a multi-purpose exerciser which comprises a substantially U-shaped base frame having two smoothed arched ends disposed in parallel and two axle holes respectively disposed adjacent to the smoothly arched ends; a back pad fixedly mounted on the U-shaped base frame on the middle and adapted for supporting the user's back; an axle mounted in the axle holes on the U-shaped base frame, the axle having two pulleys mounted on two opposite ends thereof outside the U-shaped base frame; a tubular shaft sleeved onto the axle between the axle holes on the U-shaped base frame; an elongated polyurethane rollers mounted on the tubular shaft for sitting by the user; a T-bar fixedly fastened to a back side of the back pad, the T-bar having two pulleys mounted on two opposite ends of a transverse top side thereof; a locating frame fixedly fastened to the back pad; a support frame bar adapted to support the back pad on the floor, the support frame bar comprising a transverse coupling rod at one end pivoted to the locating frame, a wheel holder at an opposite end, and two end caps respectively fastened to two opposite ends of the transverse coupling rod, the wheel holder holding a supporting wheel, and a stop member adapted to limit rotary motion of the supporting wheel within about 30° angle; a guide pulley mounted on the support frame bar adjacent to the wheel holder; a handlebar having two locating members near two opposite ends thereof; a pull rope inserted through the guide pulley, having two opposite ends respectively passed through the pulleys on the axle then the pulleys on the T-bar, and then coupled to the two locating members on the handlebar by a respective adjusting clamp; and two stop members bilaterally fastened to the pull rope and spaced between the pulleys on the T-bar and the locating members on the handlebar.

DETAILED DESCRIPTION OF THE PREFERRED EMBODIMENT

Figure 1:
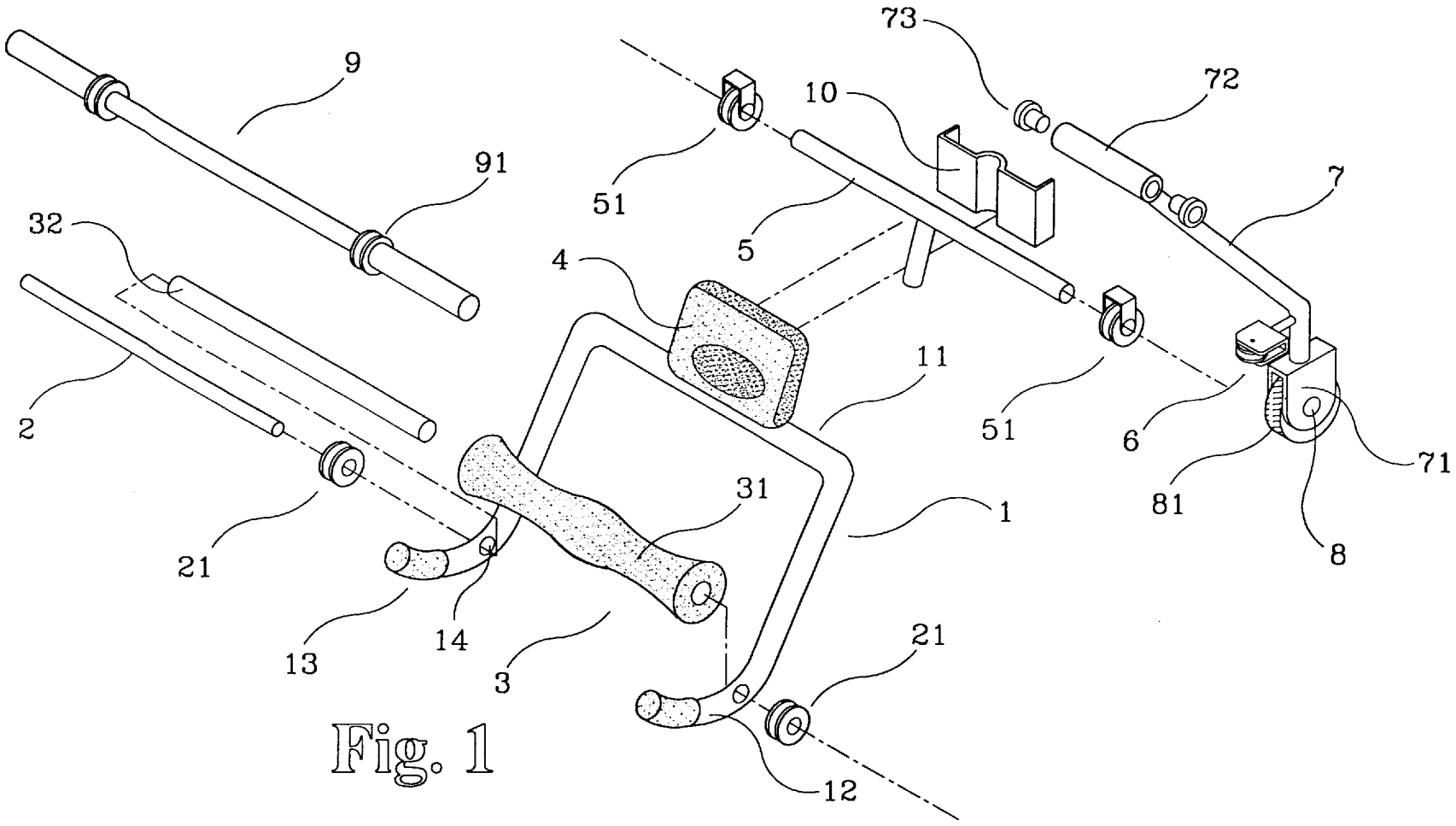
FIG. 1 is an exploded view of a multi-purpose exerciser according to the present invention.
Figure 2:
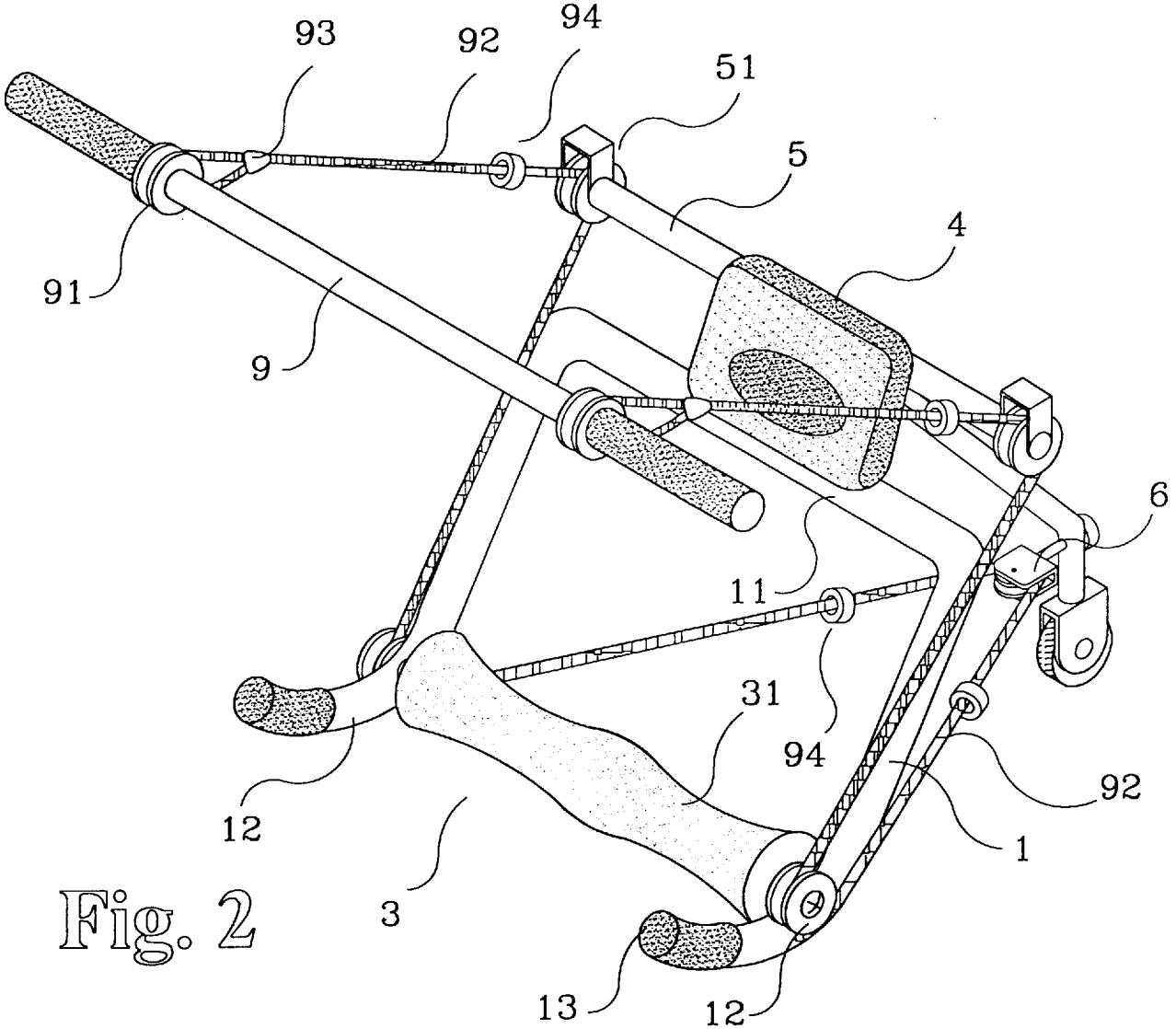
FIG. 2 is a perspective view of the multi-purpose exerciser shown in FIG. 1.

Referring to FIGS. 1 and 2, a multi-purpose exerciser in accordance with the present invention comprises a base frame 1. The base frame 1 comprises a substantially U-shaped frame rod 11 having two smoothly arched ends 12 disposed in parallel and two axle holes 14 respectively disposed adjacent to the smoothly arched ends 12, and two polyurethane caps 13 respectively covered on the smoothly arched ends 12. A back pad 4 is fixedly mounted on the U-shaped frame rod 11 on the middle. An axle 2 is mounted in the axle holes 14 on the U-shaped frame rod 11. Two pulleys 21 are respectively mounted on the axle 2 at its two opposite ends outside the U-shaped frame rod 11. A tubular shaft 32 is sleeved onto the axle 2 between the axle holes 14 on the U-shaped frame rod 11. An elongated polyurethane roller 3 is mounted on the tubular shaft 32. The rotary polyurethane roller 3 has two neck portions 31 adapted for supporting the user's hips. A T-bar 5 is fixedly fastened to the back side of the back pad 4, having two pulleys 51 mounted on two opposite ends of its transverse top side. A locating frame 10 is fixedly fastened to the back side of the back pad 4 to hold a support frame bar 7. The support frame bar 7 comprises a transverse coupling rod 72 at one end pivoted to the locating frame 10, a wheel holder 71 at an opposite end, and two end caps 73 respectively fastened to two opposite ends of the transverse coupling rod 72. The end caps 73 diminish friction resistance between the transverse coupling rod 72 and the locating frame 10. The wheel holder 71 holds a supporting wheel 81, and a stop member 8 is mounted on the wheel holder 71 to limit rotary motion of the supporting wheel 81 within about 30° angle. A guide pulley 6 is mounted on the support frame bar 7 adjacent to the wheel holder 71. A pull rope 92 is inserted through the guide pulley 6, having two opposite ends respectively passed through the pulleys 21 on the axle 2 then the pulleys 51 on the T-bar 5, and then adjustably coupled to two locating members 91 near two opposite ends of a handlebar 9 by a respective adjusting clamp 93. Two stop members 94 are bilaterally fastened to the pull rope 92 and spaced between the pulleys 51 on the T-bar 5 and the locating members 91 on the handlebar 9.

Figure 3:
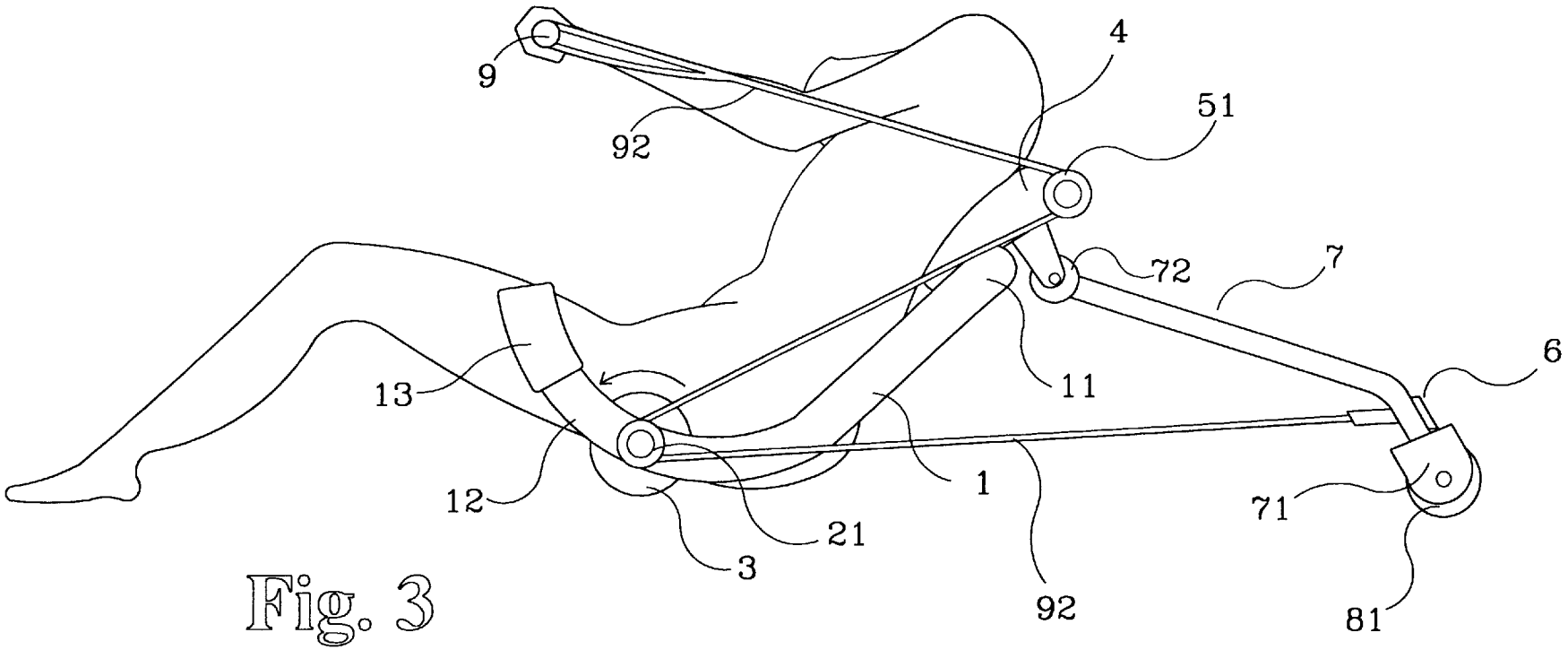
FIG. 3 shows an application example of the present invention.

Referring to FIG. 3, when in use, the user sits on the elongated polyurethane roller 3 with the back supported on the back pad 4 and the hands holding the handlebar 9, thus the user can extend out the legs and then retract then legs alternatively.

Figure 4:
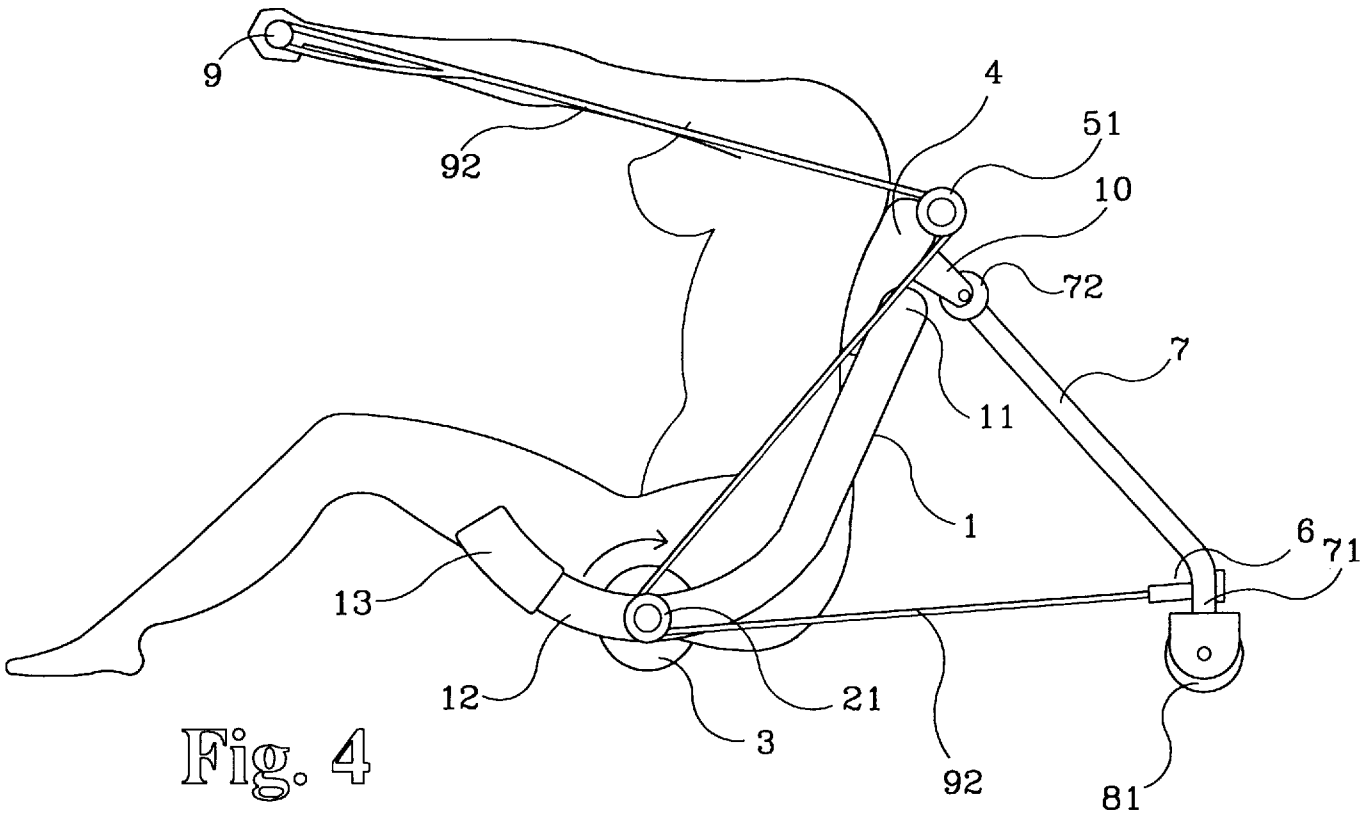
FIG. 4 shows another application example of the present invention.

Referring to FIG. 4, when the user sits on the elongated polyurethane roller 3, the handlebar 9 can alternatively be pushed forwards and then pulled backwards with the hands to exercise the greater pectoral muscle and the abdominal rectus muscle. When the handlebar 9 is pushed forwards, the base frame 11 is turned forwards, and the back pad 4 is forced to give a pressure to the user's back, and at the same time the elongated roller 3 is turned clockwise through an angle to rub against the user's hips. On the contrary, when the handlebar 9 is pulled backwards, the base frame 11 is turned backwards, and the pressure of the back pad 4 is released from the user's back, and at the same time the elongated roller 3 is turned counter-clockwise through an angle to rub against the user's hips again.

Figure 5:
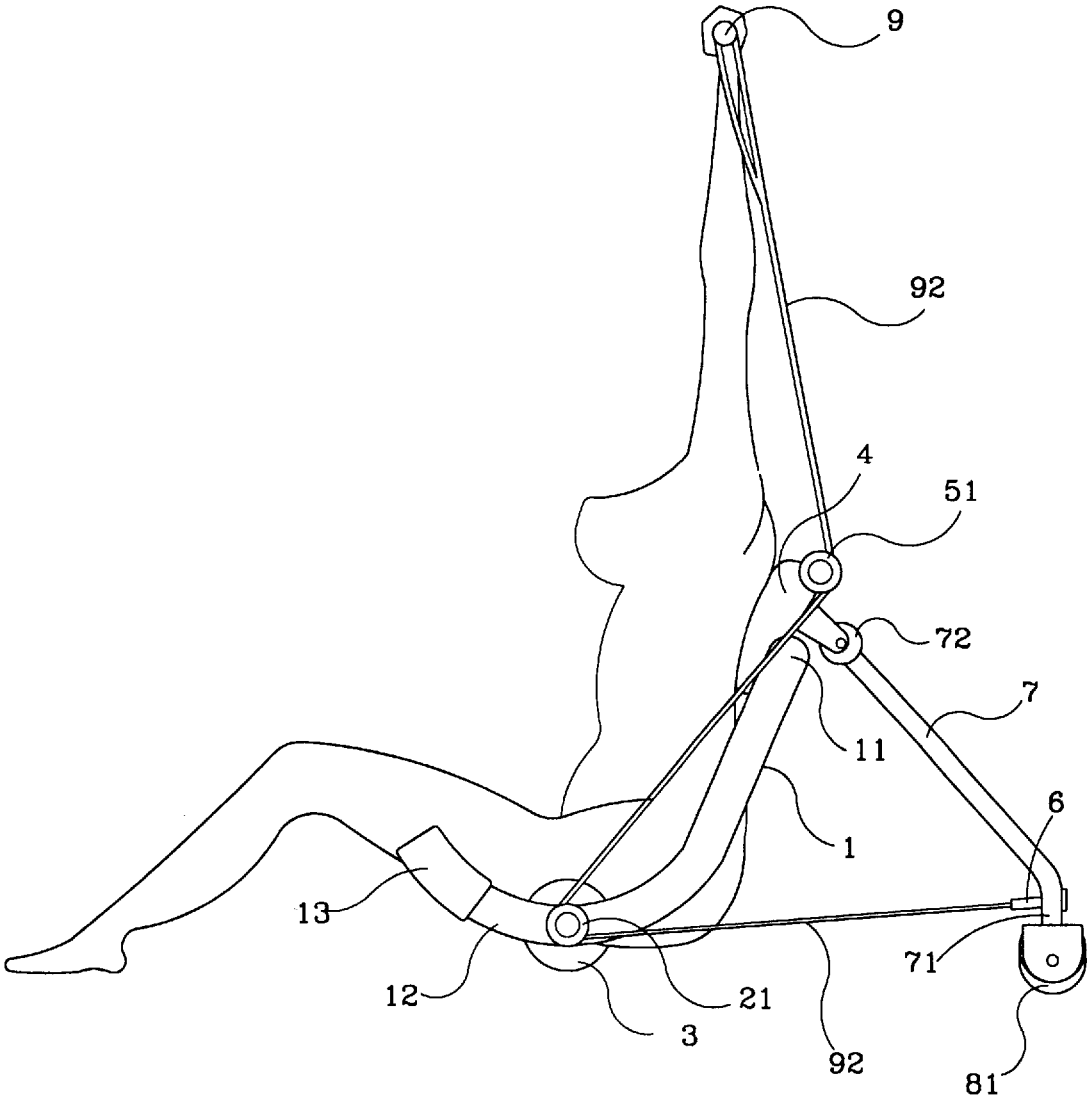
FIG. 5 shows still another application example of the present invention.

Referring to FIG. 5, when the user sits on the elongated polyurethane roller 3, the handlebar 9 can alternatively be pushed upwards and then pulled downwards with the hands to exercise the greater pectoral muscle, the deltoid muscle and the external oblique muscle.

While only one embodiment of the present invention has been shown and described, it will be understood that various modifications and changes could be made thereunto without departing from the spirit and scope of the invention disclosed.

What the invention claimed is:

1. A multi-purpose exerciser comprising:

a substantially U-shaped base frame having two smoothed arched ends disposed in parallel and two axle holes respectively disposed adjacent to said smoothly arched ends;

a back pad fixedly mounted on said U-shaped base frame on the middle and adapted for supporting the user's back;

an axle mounted in the axle holes on said U-shaped base frame, said axle having two pulleys mounted on two opposite ends thereof outside said U-shaped base frame;

a tubular shaft sleeved onto said axle between the axle holes on said U-shaped base frame;

an elongated polyurethane roller mounted on said tubular shaft for sitting by the user;

a T-bar fixedly fastened to a back side of said back pad, said T-bar having two pulleys mounted on two opposite ends of a transverse top side thereof;

a locating frame fixedly fastened to said back pad;

a support frame bar adapted to support said back pad on the floor, said support frame bar comprising a transverse coupling rod at one end pivoted to said locating frame, a wheel holder at an opposite end, and two end caps respectively fastened to two opposite ends of said transverse coupling rod, said wheel holder holding a supporting wheel, and a stop member adapted to limit rotary motion of said supporting wheel within about a 30° angle;

a guide pulley mounted on said support frame bar adjacent to said wheel holder;

a handlebar having two locating members near two opposite ends thereof;

a pull rope inserted through said guide pulley, having two opposite ends respectively passed through the pulleys on said axle then the pulleys on said T-bar, and then coupled to the two locating members on said handlebar by a respective adjusting clamp; and two stop members bilaterally fastened to said pull rope and spaced between the pulleys on said T-bar and the locating members on said handlebar.

2. The multi-purpose exerciser of claim 1, wherein said substantially U-shaped base frame includes two polyurethane caps respectively covering its two smoothly arched ends.

3. The multi-purpose exerciser of claim 1, wherein said rotary polyurethane roller has two neck portions adapted for supporting the user's hips.

* * * * *